US008341788B2

(12) United States Patent
Kim et al.

(10) Patent No.: US 8,341,788 B2
(45) Date of Patent: Jan. 1, 2013

(54) METHOD FOR CONSTRUCTING PRECAST COPING FOR BRIDGE

(75) Inventors: Tae-Hoon Kim, Seongnam-si (KR); Se-Jin Park, Seongnam-si (KR); Young-Jin Kim, Seongnam-si (KR); Seong-Woon Kim, Seoul (KR)

(73) Assignee: Daewoo E&C Co., Ltd., Seoul (KR)

( * ) Notice: Subject to any disclaimer, the term of this patent is extended or adjusted under 35 U.S.C. 154(b) by 135 days.

(21) Appl. No.: 12/900,572

(22) Filed: Oct. 8, 2010

(65) Prior Publication Data

US 2011/0278752 A1 Nov. 17, 2011

(30) Foreign Application Priority Data

Oct. 26, 2009 (KR) ..... 10-2009-0101831

(51) Int. Cl.
*E01D 21/00* (2006.01)
*E01D 19/02* (2006.01)

(52) U.S. Cl. ..... 14/77.3; 14/75; 14/77.1

(58) Field of Classification Search ..... 14/77.1, 14/73.5, 74.5, 75, 77.3, 78; 52/223.5
See application file for complete search history.

(56) References Cited

U.S. PATENT DOCUMENTS 2,583,626 A * 1/1952 Buell ..... 249/102
2,921,354 A * 1/1960 Pankey ..... 249/9
3,049,784 A * 8/1962 Cullen ..... 425/414
3,879,914 A * 4/1975 Haller et al. ..... 52/745.13
3,892,096 A * 7/1975 Macchi ..... 52/223.11
4,123,485 A * 10/1978 Tang ..... 264/33
4,147,009 A * 4/1979 Watry ..... 52/742.15
4,149,306 A * 4/1979 Tice ..... 29/452
4,185,440 A * 1/1980 Finsterwalder ..... 52/745.19
4,373,837 A * 2/1983 Lin et al. ..... 405/218
4,509,305 A * 4/1985 Guinard ..... 52/223.11
4,910,940 A * 3/1990 Grady, II ..... 52/849
4,972,537 A * 11/1990 Slaw, Sr. ..... 14/77.1
4,977,636 A * 12/1990 King ..... 14/73
5,406,663 A * 4/1995 Chen ..... 14/75
5,439,629 A * 8/1995 Heintz et al. ..... 264/228
5,655,243 A * 8/1997 Kim ..... 14/74.5
5,771,518 A * 6/1998 Roberts ..... 14/73.1
5,826,387 A * 10/1998 Henderson et al. ..... 52/295
5,867,855 A * 2/1999 Kim ..... 14/77.1
5,867,954 A * 2/1999 Lin ..... 52/223.12
6,098,357 A * 8/2000 Franklin et al. ..... 52/223.7
6,345,403 B1 * 2/2002 Nagle ..... 14/77.1
6,470,524 B1 * 10/2002 Mairantz ..... 14/77.1
6,588,160 B1 * 7/2003 Grossman ..... 52/223.7
7,546,656 B2 * 6/2009 Kim et al. ..... 14/77.1
7,618,217 B2 * 11/2009 Henderson ..... 405/255
7,805,895 B2 * 10/2010 Kristensen ..... 52/169.9
7,827,642 B2 * 11/2010 Han ..... 14/74.5
7,895,799 B2 * 3/2011 Hillman et al. ..... 52/223.8
8,006,339 B1 * 8/2011 Bennett ..... 14/73.5
8,020,235 B2 * 9/2011 Grace ..... 14/74.5
2005/0144890 A1 * 7/2005 Kim et al. ..... 52/720.1
2011/0030299 A1 * 2/2011 Raynor ..... 52/295

* cited by examiner

*Primary Examiner* — Raymond W Addie
(74) *Attorney, Agent, or Firm* — Kile Park Goekjian Reed & McManus PLLC

(57) ABSTRACT

The method for constructing precast coping for bridge enables for a segment to be match-cast manufactured at the top of a pier body. The method may be applied to small and medium size bridges by introducing transverse tendon force to each segment through tendons after manufacturing a sub-segment which is match cast manufactured using sides of a pre-made segment as molding. Further, the method for constructing precast coping for bridge enables to construct precast coping for bridge by easily lifting the coping, which is assembled on the ground, using lifting lugs that are formed on the top of manufacturing segments.

12 Claims, 18 Drawing Sheets

METHOD FOR CONSTRUCTING PRECAST COPING FOR BRIDGE

TECHNICAL FIELD

The present invention relates to a method for constructing precast coping for bridge. More particularly, the present invention relates to a method for constructing precast coping for bridge to use a main segment match-cast manufactured with the top of a pier body, to introduce a subsegment match-cast manufactured with both sides of the main segment to transverse tendon force through tendons, and to install lifting lugs on the top of the main segment or the subsegment.

BACKGROUND

Coping is formed on the top of a body in order to have a width corresponding to a transverse width of a bridge for supporting a girder in the top of a pier. Previously, after assembling and installing mould on the top of the bridge and pouring concrete while gradually constructing the bridge from the bottom of the bridge in place, concrete is cured and the coping is built on the top of the pier by disassembling the mould.

Meanwhile, the construction of bridges due to cast-in-place concrete has been less used for the reasons of the long period of construction, environmental problems, and civil complaints caused by environmental problems. Instead, the method for quick assembling and constructing pre-formed segments in a construction site has been widely used.

The fast construction method has been appearing as an alternative in that not only can the whole period of bridge construction be reduced, but environmental problems and civil complaints can be minimized. Also, it is true that the fast construction method helps construction environment mechanized by using large equipment.

There are advantages in which since a unit structure manufactured as a precast type, i.e., a segment, is manufactured in a uniform place and the quality of concrete is easily maintained, it is easy to maintain high-quality members; since segments are continuously manufactured, it is easy to control manpower and be used for mould only; and since segments may be manufactured with base construction, air may be cut as compared with the cast-in-place method.

If the assembling method is used, the bridge is constructed by gradually lifting up and assembling the pier body and the coping, manufactured with a plurality of segments, with cranes after building base concrete in which base sites are dug from the surface of the ground in place.

As above, in case that bridges are constructed by the assembling method, the body and the coping, composed of each unit structure, are lifted up by cranes and therefore, it may be much safer as self weight is getting reduced.

Therefore, the method for reducing the weight of the segment has been mainly studied. However, even though the weight of the segment is decreased, bearing capacity or seismic performance of the assembled bridges should not be diminished.

Especially, as for bridges, since a post and a coping are mainly affected by compressive load and bending load, respectively, the size of the side of the coping is generally large. Also, since the coping is usually more than a minimum of 10 meters long, the total weight of the coping is commonly quite heavy.

Therefore, the way to sharply reduce the self weight of the coping should be found out in order to seek the assembly bridge constructing method. As for girders, the size of the load for the coping is approximately 500 tons, five times of the size of the load for each girder, whereas the size of the load for each girder is generously approximately 100 tons. Therefore, the size of the side of the coping should be extremely bigger than that of the girder.

For this reason, the weight of the coping must be extremely large and therefore, the way to reduce self weight has been studied for fragmenting the coping.

To solve the above problem, a lightened coping for bridge was invented.

As illustrated in FIG. 1, the lightened coping for bridge (30) is composed of: a vertical wall (31) to which a plurality of steel wires (33) and a hollow pipe (35) are inserted in a longitudinal direction; and a support (32) to which one side of a plurality of the girders (40), protruded from the bottom of the vertical wall (31) in right and left direction, is installed. Especially, H beam (34) is inserted in a longitudinal direction of the vertical wall (31) in the position in which the vertical wall (31) is faced in the support (32) (i.e., the bottom of the vertical wall (31)), and a plurality of girder supports (32*a*, 32*b*, 32*c*) in the side, protruded in right and left direction from the support (32), are mutually and independently protruded. One side of the girder (40) is installed on the girder supports (32*a*, 32*b*, 32*c*) independently protruded in right and left direction.

However, it is difficult for the lightened coping for bridge to be moved after manufacture because the width of the coping of the lightened coping for bridge is the same as that of the bridge. Also, it is impossible to be applied except small-sized bridges due to its weight.

DETAILED DESCRIPTION OF THE INVENTION

Problems the Invention Solves

Figure 1:
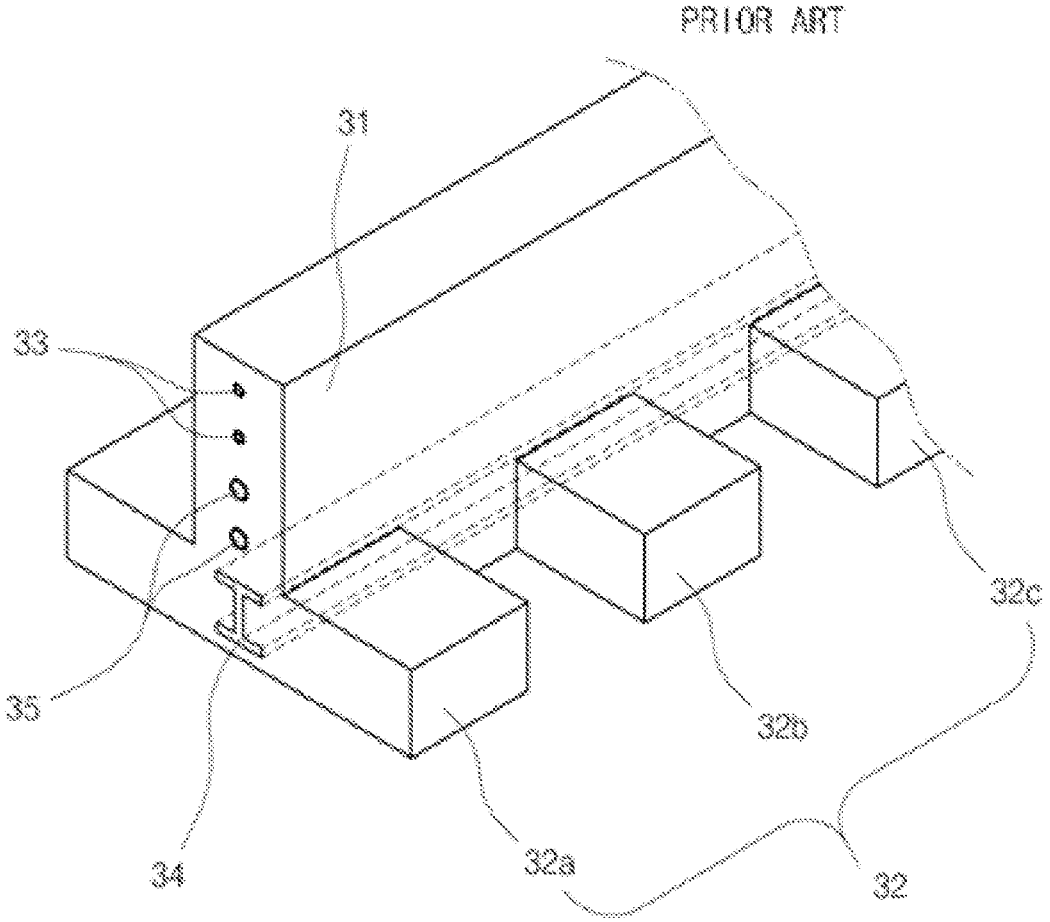
FIG. 1 is a drawing representing lightened coping for bridge in the prior art.

To solve the above problems, the object of the method for constructing precast coping for bridge of the present invention is to manufacture a segment match-cast manufactured with the top of a pier body; to be applied to small and medium size bridges by introducing transverse tendon force to each segment through tendons after manufacturing a subsegment which is match cast to both sides of the pre-made segment; to be rapidly produced; and to retension tendons when the coping is constructed by using a plurality of segments.

Further, the other object of the method for constructing precast coping for bridge of the present invention is to manufacture the method for constructing precast coping for bridge, enabling to obtain stability towards lift by easily lifting the coping, assembled on the ground, through lifting lugs by forming lifting lugs on the top upon manufacturing segments.

Additionally, the other objects of the method for constructing precast coping for bridge of the present invention are to manufacture a main segment with the upper side of the segment, corresponding to the top pier body, as molding upon manufacturing neighboring segments; to easily combine each segment in the construction by manufacturing a new segment with the side of the main segment as molding or match-cast manufacturing other new segments with the side of new segments as molding; and to previously protect water leakage through discontinuity of each segment upon displaying tendons to neighboring segments continuously by deleting discontinuity of each neighboring segment.

Further, the other objects of the method for constructing precast coping for bridge of the present invention are to connect each segment solidly by interconnecting segments through a shear key upon assembling each neighboring segment and to support the weight on the surface effectively.

Furthermore, the other object of the method for constructing precast coping for bridge of the present invention is to be easily delivered by a segment unit after construction due to segment unit manufacture in factories.

Technical Problem

To accomplish the above object, the present invention is directed to a method for constructing precast coping for bridge, characterized in comprising: main segment manufacturing process for manufacturing a main segment to stack match-cast bottom of the main segment to the upper side of the top segment by using the surface of the top segment from pier body segments and molding and to form a first transverse sheath pier penetrating transverse tendons; subsegment manufacturing process for manufacturing a subsegment to build a second transverse sheath pier corresponding to the first transverse sheath pier of the main segment penetrating the transverse tendons when the subsegment is match-cast manufactured by using the both sides of the main segment as molding; transverse tendon force introducing process for introducing transverse tendon force through the transverse tendons which are inserted to the first transverse sheath pier and the second transverse sheath pier after combining the subsegment to the both sides of the main segment; and the longitudinal tendon force introducing process for introducing longitudinal tendon force through longitudinal tendons inserted to the longitudinal sheath pier after lifting the main segment in which the subsegment is combined to both sides and stacking the main segment to the upside of the pier body segment.

Here, the method for constructing precast coping for bridge further comprises additional segment manufacturing process for manufacturing the additional segment to form a third transverse sheath pier corresponding to the first transverse sheath pier and the second transverse sheath pier penetrating the transverse tendons through match casting in which the both sides of the segment is used as molding.

Also, the main segment includes a socket corresponding to a shear connector of the body segment, a longitudinal sheath pier, a vertical steel bar, and a horizontal steel bar.

Here, a plurality of lifting lugs are inserted to the upside of the main segment, and a plurality of protruded shear keys are installed to the both sides of the main segment.

Additionally, the lifting lug consists of: a plurality of anchors for forming a tap to combine nuts on the top, forming a curve on the bottom, welding and fixing the horizontal steel bar of the main segment to the top and the bottom, and protrudedly forming the top toward the top of the main segment when the anchors are shaped like a circle stick; a base for forming a first anchor hole, into which the anchor is penetrated, and being horizontally laid on the top of the main segment when the base is shaped like a metal rectangular plate; a slab for forming a second anchor hole, into which the anchor is penetrated, and being fixed to any one of upper sides of the main segment, subsegment, and additional segment, which are the positions corresponding to the base, by the nut of the anchor when the slab is shaped like a metal rectangular plate as the same as the base; and transverse tendons for being longitudinally welded and combined in the center of the upper side of the slab.

Here, transverse tendons consist of: a main body for protrudedly forming a center with a curve, forming a lifting hole, and being vertically welded and connected to the upper side of the slab when the main body is shaped like a metal rectangular plate; a reinforcing raised spot which is all formed around the lifting hole of the main body; and a support panel for welding one side in order to be vertically crossed with the main body, vertically welding and combining the bottom to the upper side of the slab, and supporting both ends of the main body.

Here, if road transport load of the main segment is exceeded, two divided sides are match-cast manufactured each other, a plurality of protruded shear connectors are installed to the bottom of divided sides, and the socket is installed to combine the shear connector to the upper side of divided sides when the main segment is horizontally divided.

In addition, the subsegment includes a shear key groove combined to the shear key of the main segment in one side, and a plurality of protruded subshear keys in the other sides.

Moreover, the additional segment includes a subshear key groove combined to the subshear key of the subsegment in one side.

Also, epoxy is applied and adhered between the main segment and the subsegment or the subsegment and the additional segment.

Further, the connection part of the main segment and the subsegment or the subsegment and the additional segment is not piled up with bridge support or critical sections.

Furthermore, the main segment and the additional segment, or the main segment, the subsegment and the additional segment determine partition number of each segment depending upon road transport load.

Effects

According to the method for constructing precast coping for bridge of the present invention, constituted as above, it enables to be applied to small and medium size bridges by introducing each neighboring segment to transverse tendon force through tendons when coping is constructed by using a plurality of segments; to relatively reduce manufacturing period and costs due to rapid construction; and be easily maintained by retensioning tendons when the coping is constructed by using a plurality of segments.

More, according to the present invention, it enables to easily lift coping upon lifting and to obtain stability towards lifting by forming lifting lugs on the ground upon manufacturing segments and combining lifting lugs and lifting devices, which are formed in the coping assembled on the ground, through ropes or wires.

Moreover, according to the present invention, it enables to easily combine each segment upon match-cast manufacturing an additional segment with the side of the pre-made segment as molding when manufacturing neighboring segment, and to previously protect water leakage through discontinuity of each segment upon displaying tendons to neighboring segments continuously by deleting discontinuity of each neighboring segment.

In addition, according to the present invention, it enables to connect each segment solidly by interconnecting segments through a shear key upon assembling each neighboring segment and to support the weight on the surface effectively.

Moreover, according to the present invention, it enables to be easily delivered by segment unit after construction due to segment unit manufacturing in factories.

TYPES FOR EXECUTION OF THE INVENTION

Hereinafter, an explanation of the method for constructing precast coping for bridge according to the present invention will be given with reference to the attached drawings.

A detailed explanation on the known functions and configurations related to this invention will be avoided for the brevity of the description. And, the terms as will be mentioned below are used by the functions defined in this invention, which is of course varied in accordance with the intension or rules of a user or operator. Therefore, the definition of the terms should be based upon the contents of the description of the invention.

Figure 2:
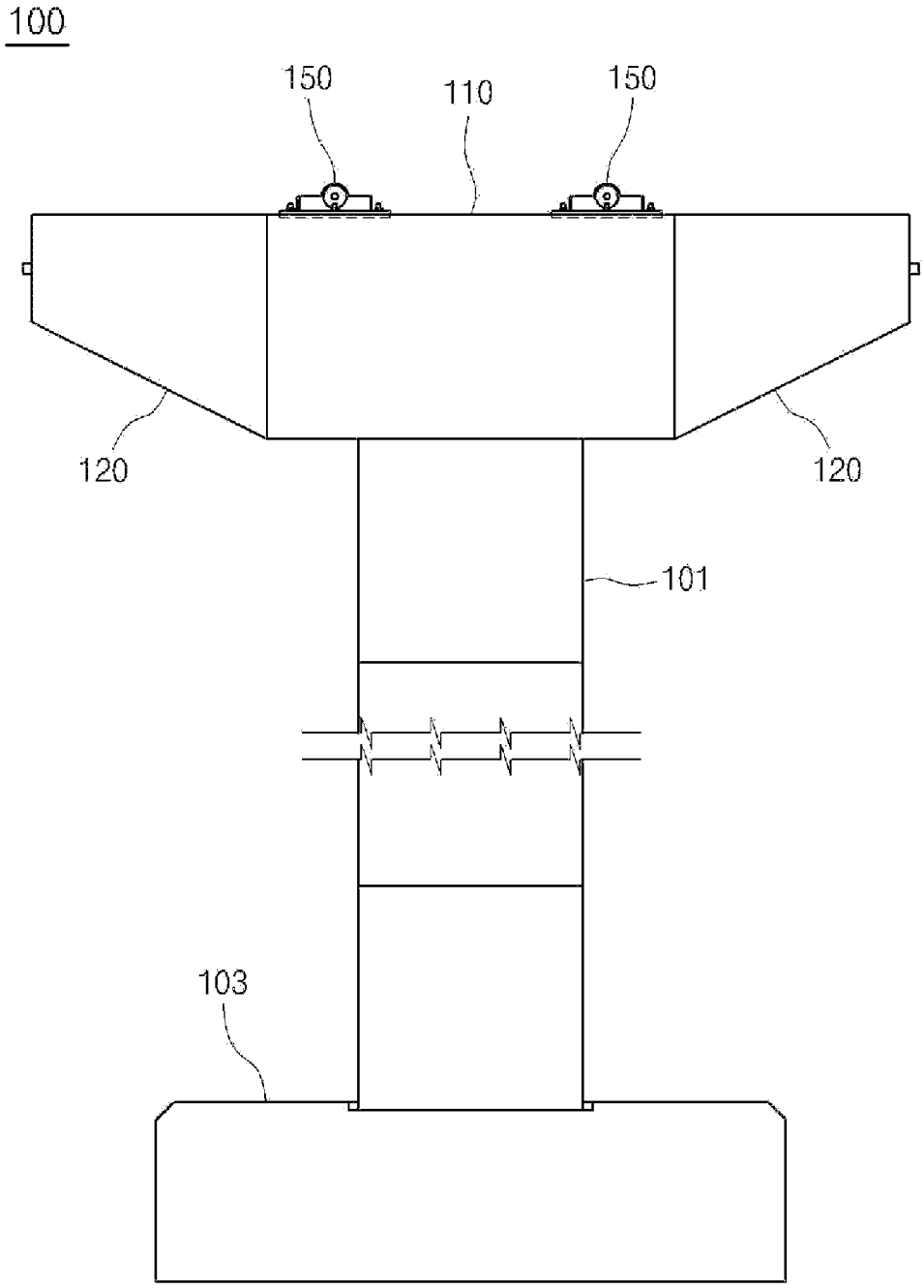
FIG. 2 is a side view representing the precast coping constitution according to the method for constructing precast coping for bridge of the present invention.
Figure 3:
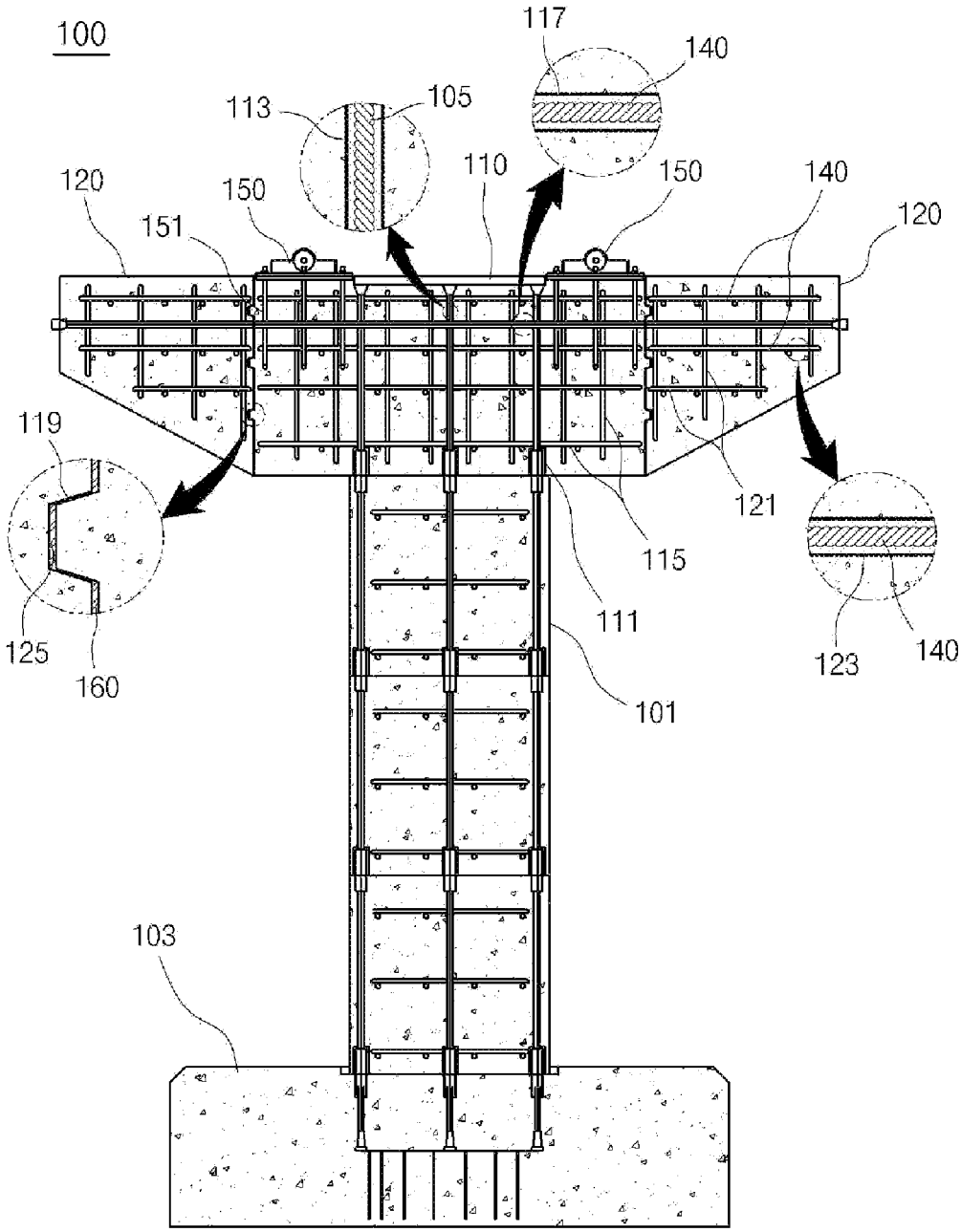
FIG. 3 is a side section representing the precast coping constitution according to the method for constructing precast coping for bridge of the present invention.
Figure 4:
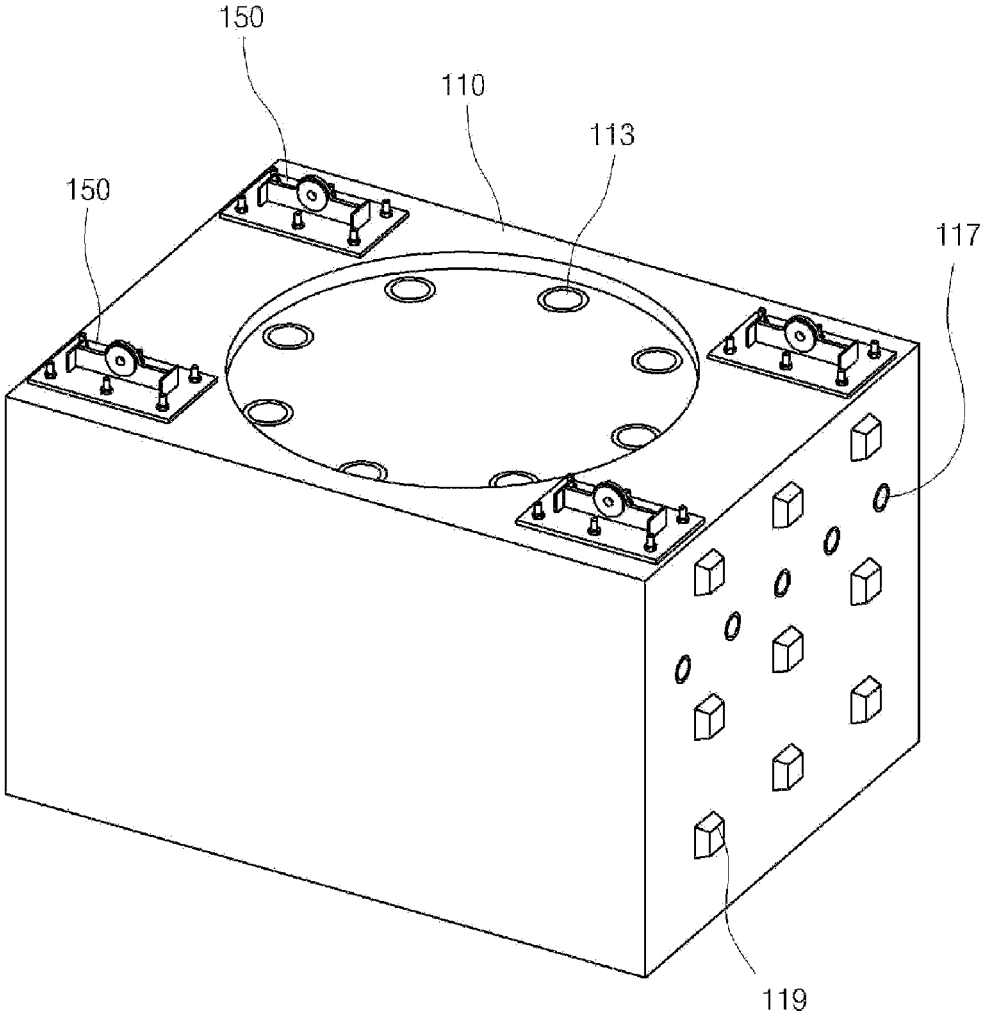
FIG. 4 is a perspective drawing representing the constitution of the main segment of FIG. 2.
Figure 5:
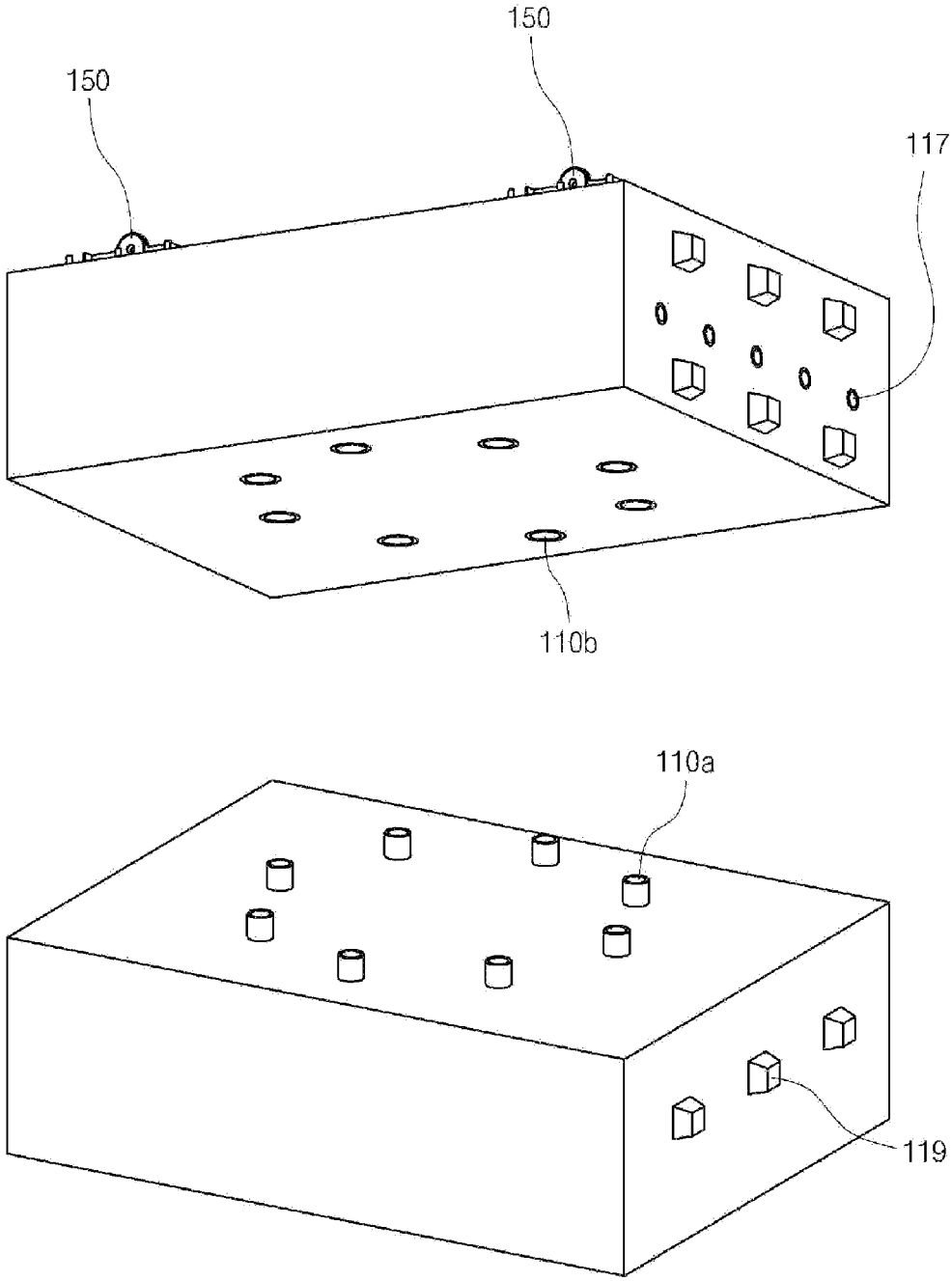
FIG. 5 is an exploded drawing representing the constitution of another embodiment of the main segment of FIG. 2.
Figure 6:
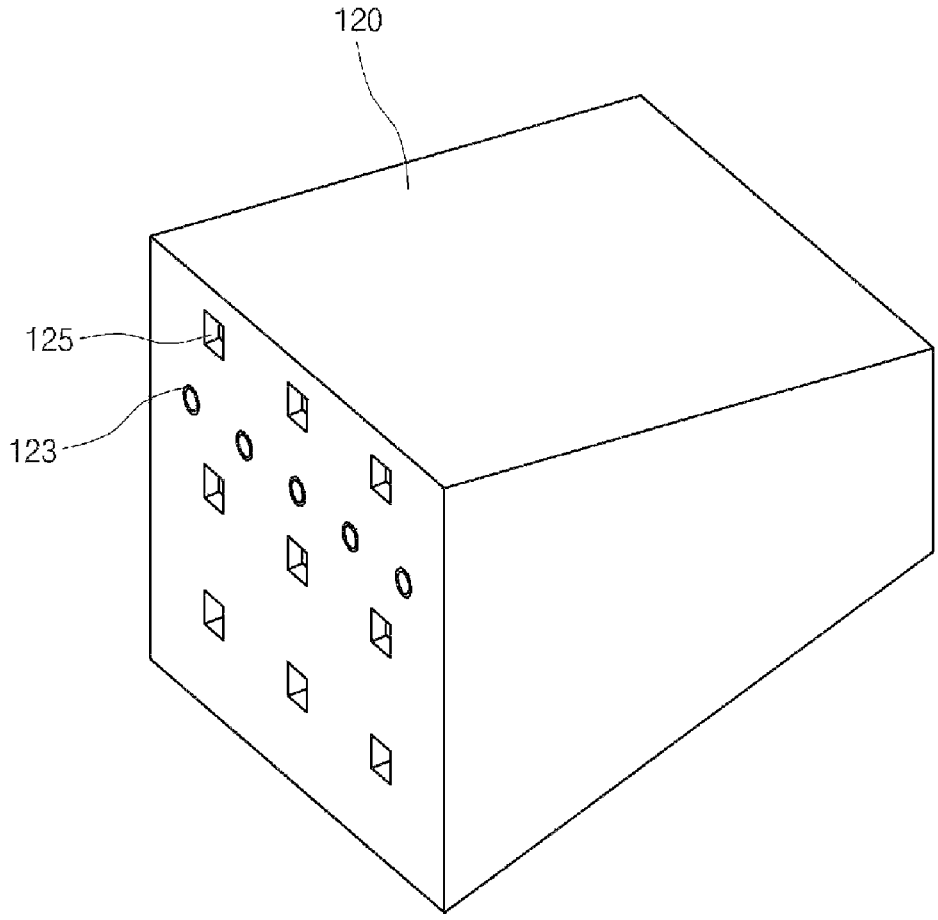
FIG. 6 is a perspective drawing representing the constitution of the subsegment of FIG. 2.
Figure 7:
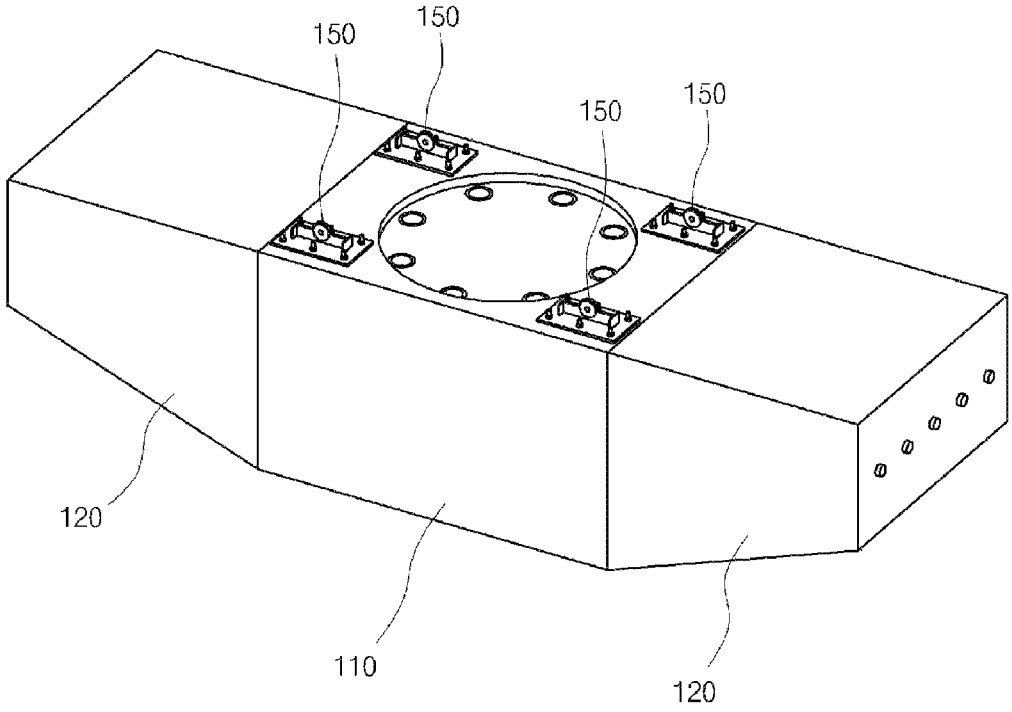
FIG. 7 is a perspective drawing representing the constitution of the precast coping according to the method for constructing precast coping for bridge of the present invention.
Figure 8:
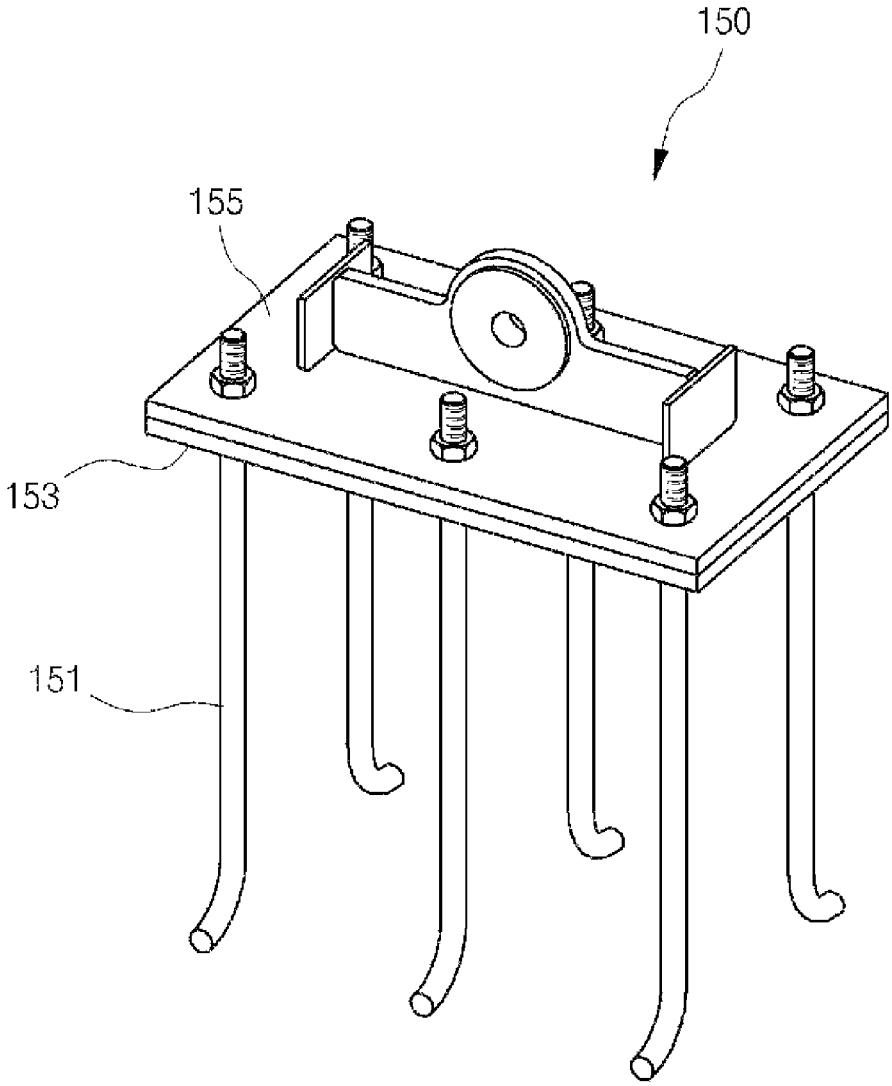
FIG. 8 is a perspective drawing representing the constitution of the lifting lug of the precast coping of the present invention.
Figure 9:
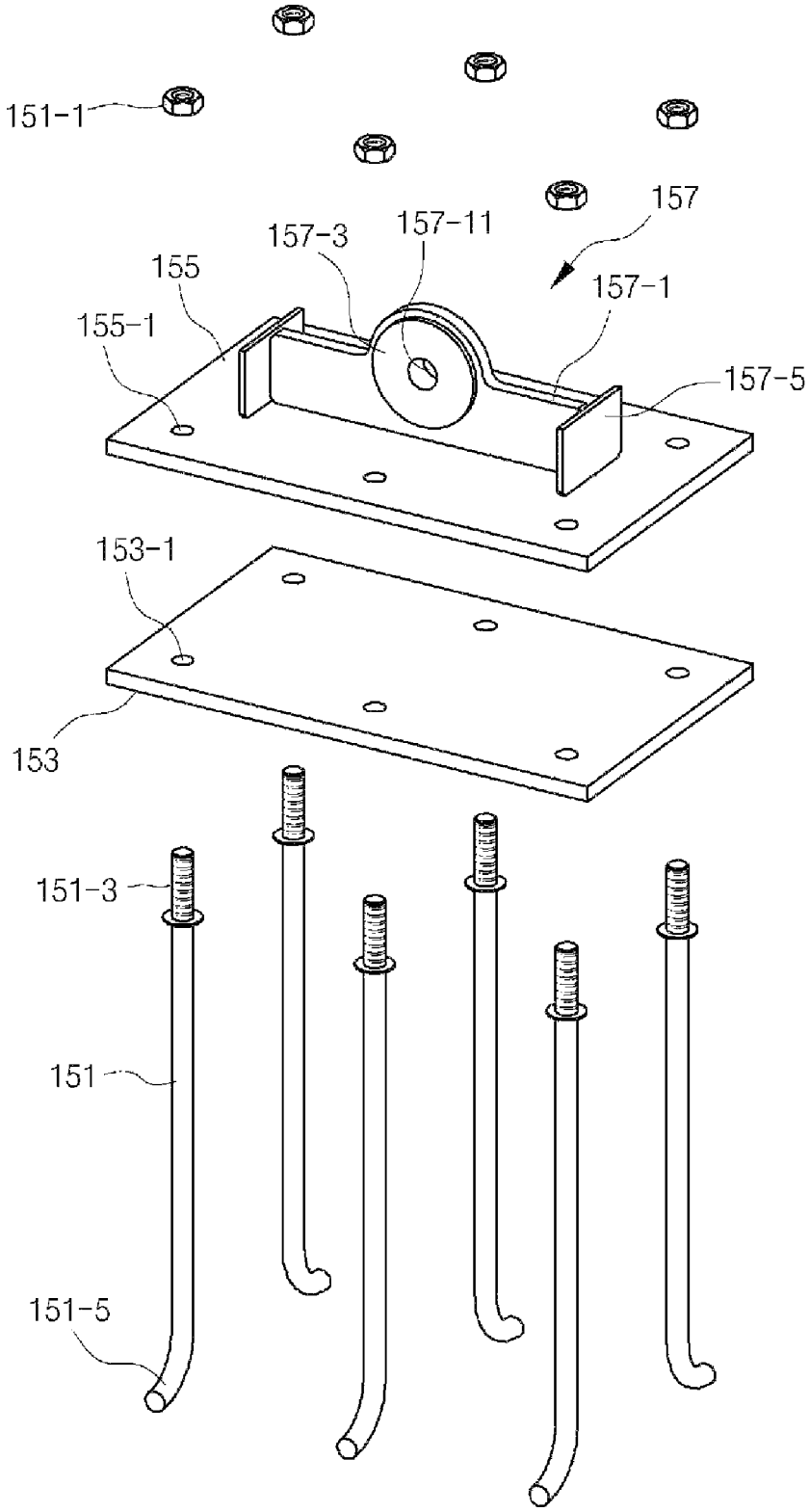
FIG. 9 is an exploded drawing of FIG. 8.
Figure 10:
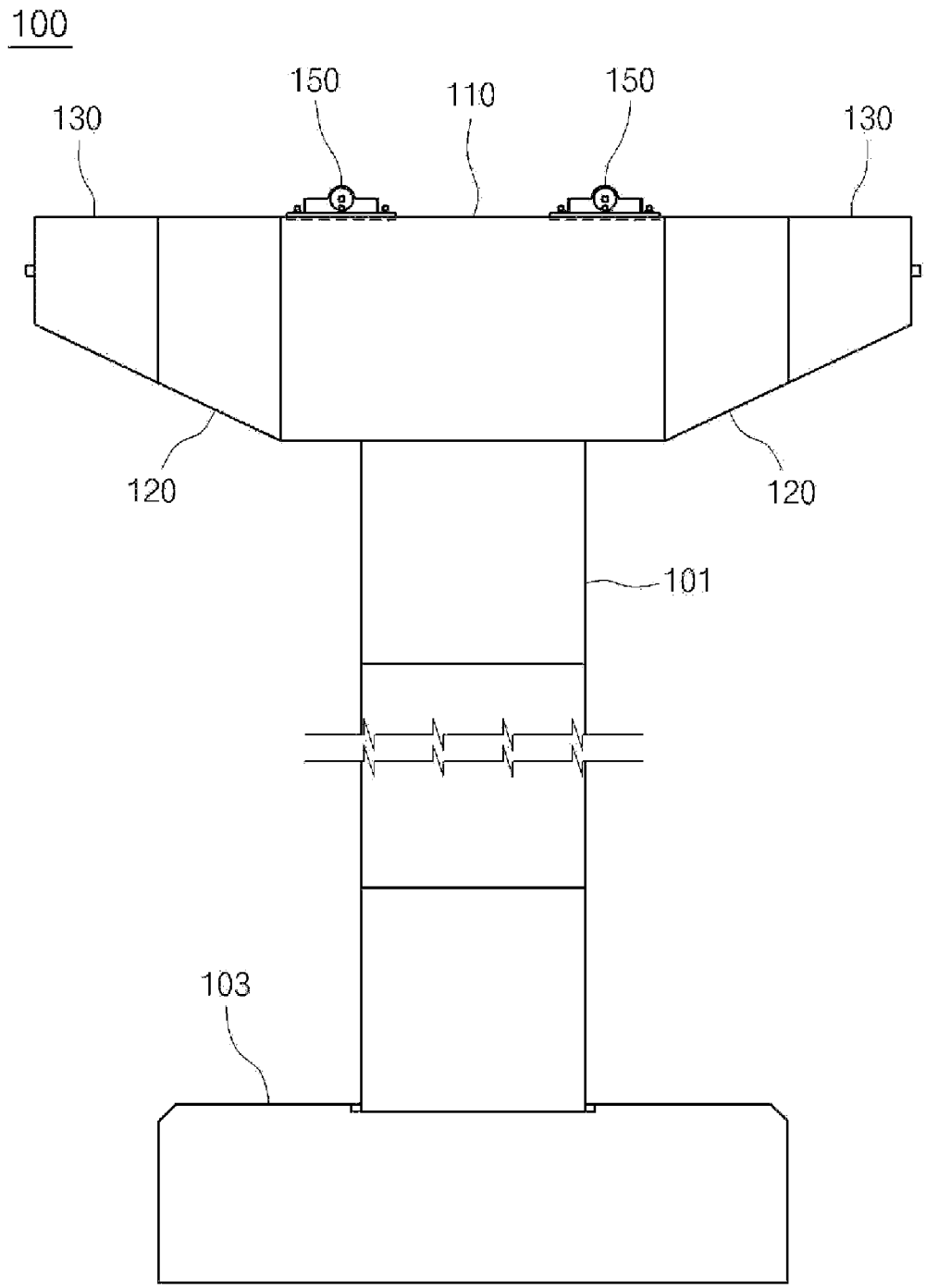
FIG. 10 is a side view representing the constitution of the precast coping according to another embodiment of the method for constructing precast coping for bridge of the present invention.
Figure 11:
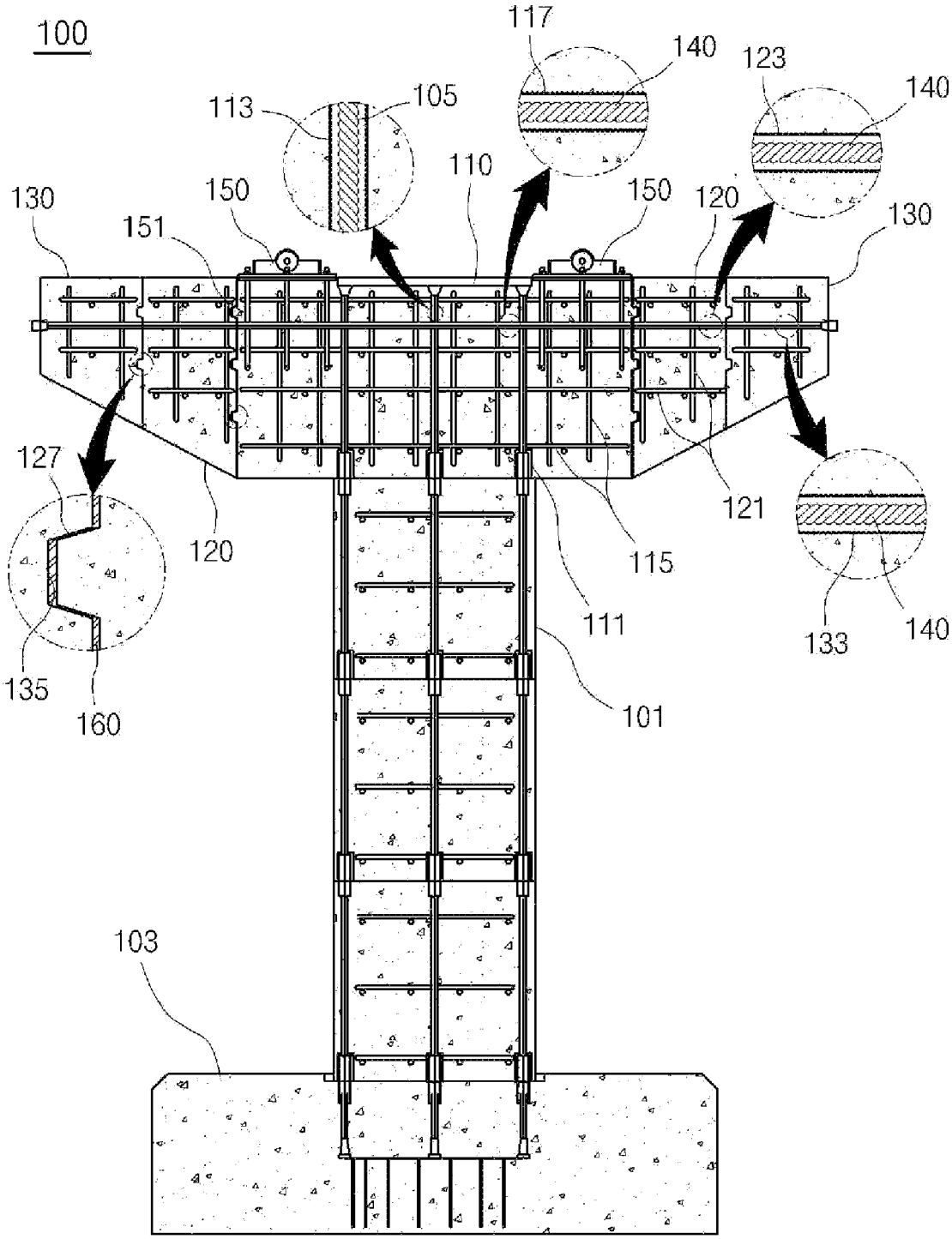
FIG. 11 is a side section representing the constitution of precast coping according to another embodiment of the method for constructing precast coping for bridge of the present invention.
Figure 12:
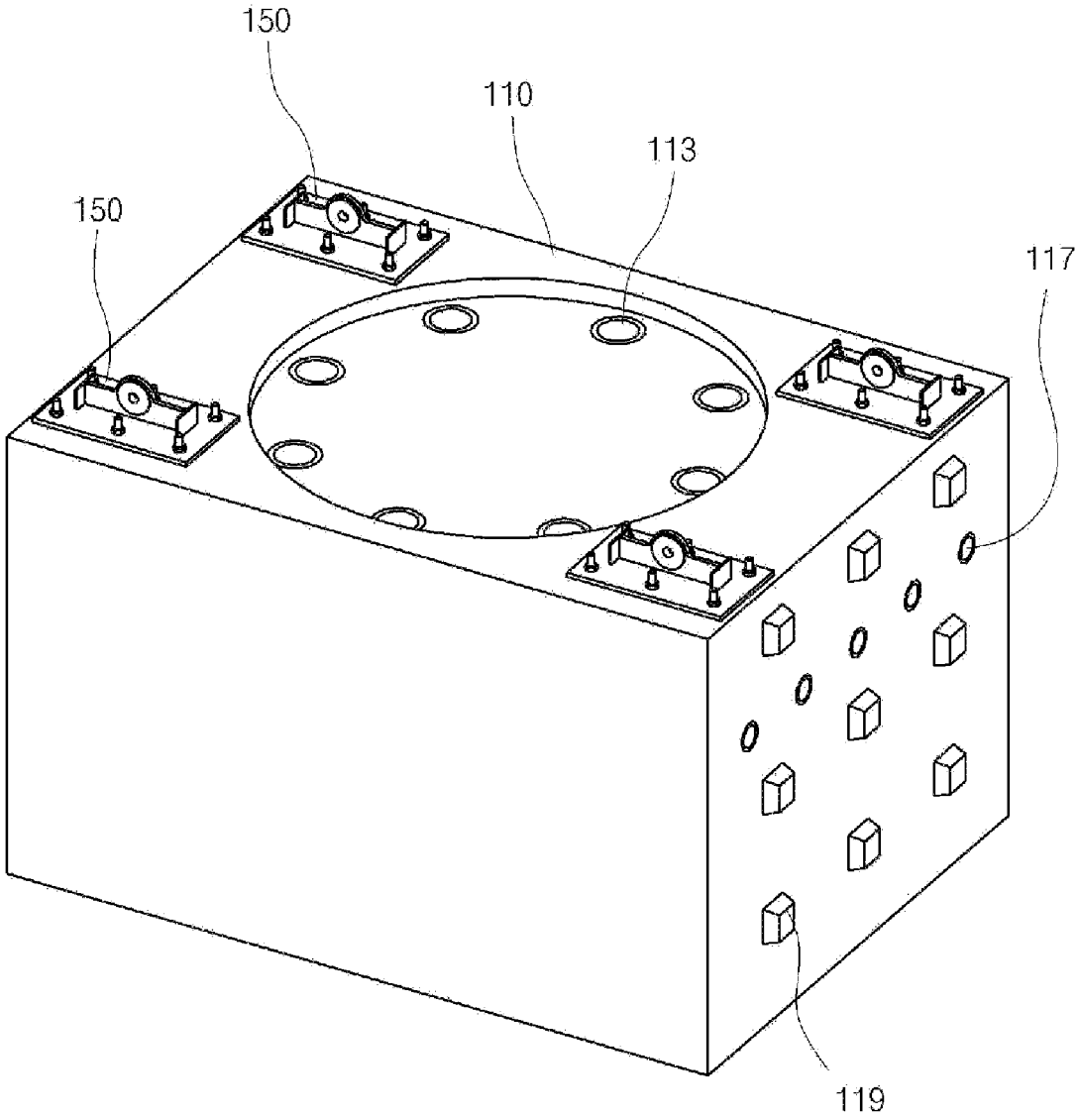
FIG. 12 is a perspective drawing representing the constitution of the main segment of FIG. 10.
Figure 13:
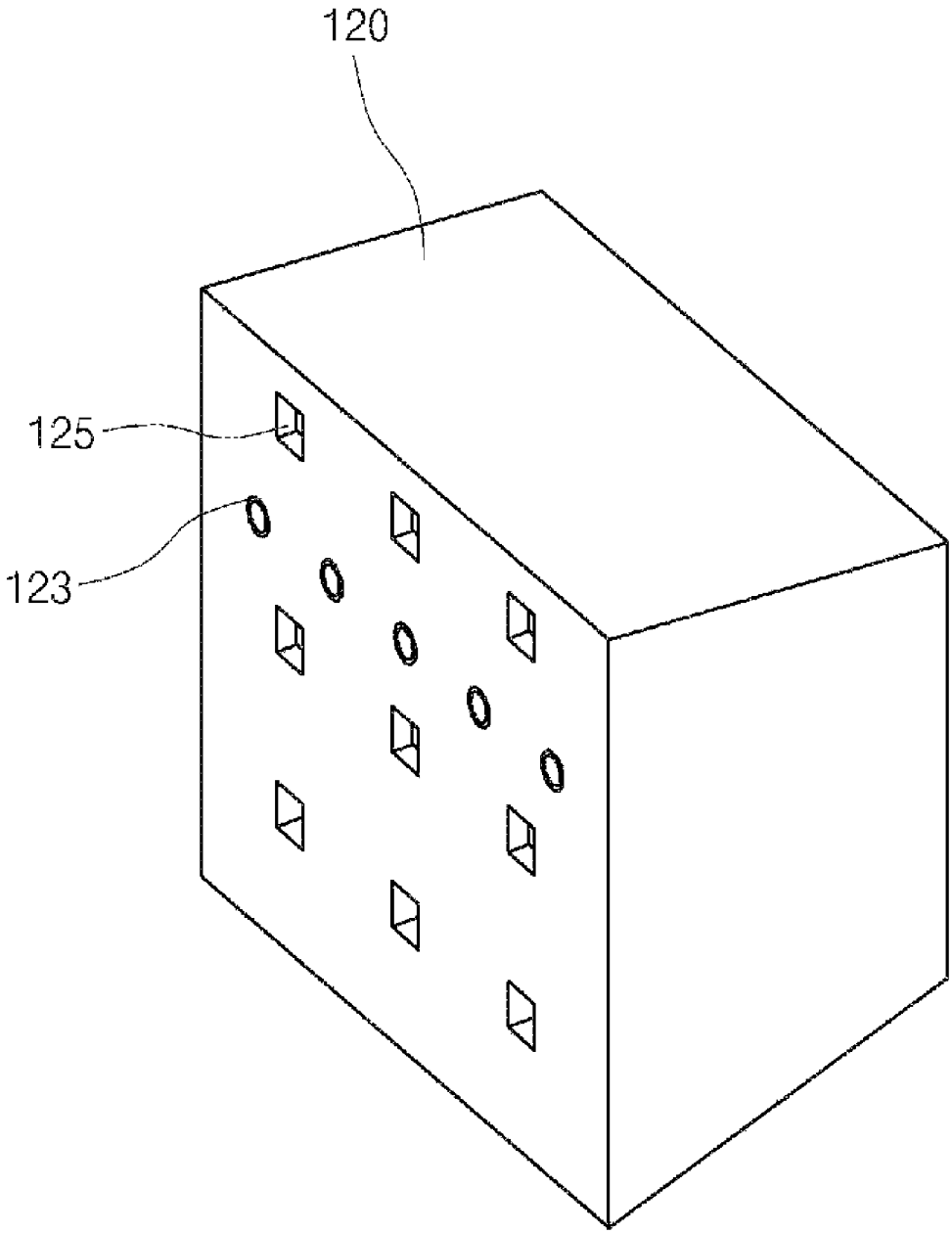
FIG. 13 is a perspective drawing representing the constitution of the subsegment of FIG. 10.
Figure 14:
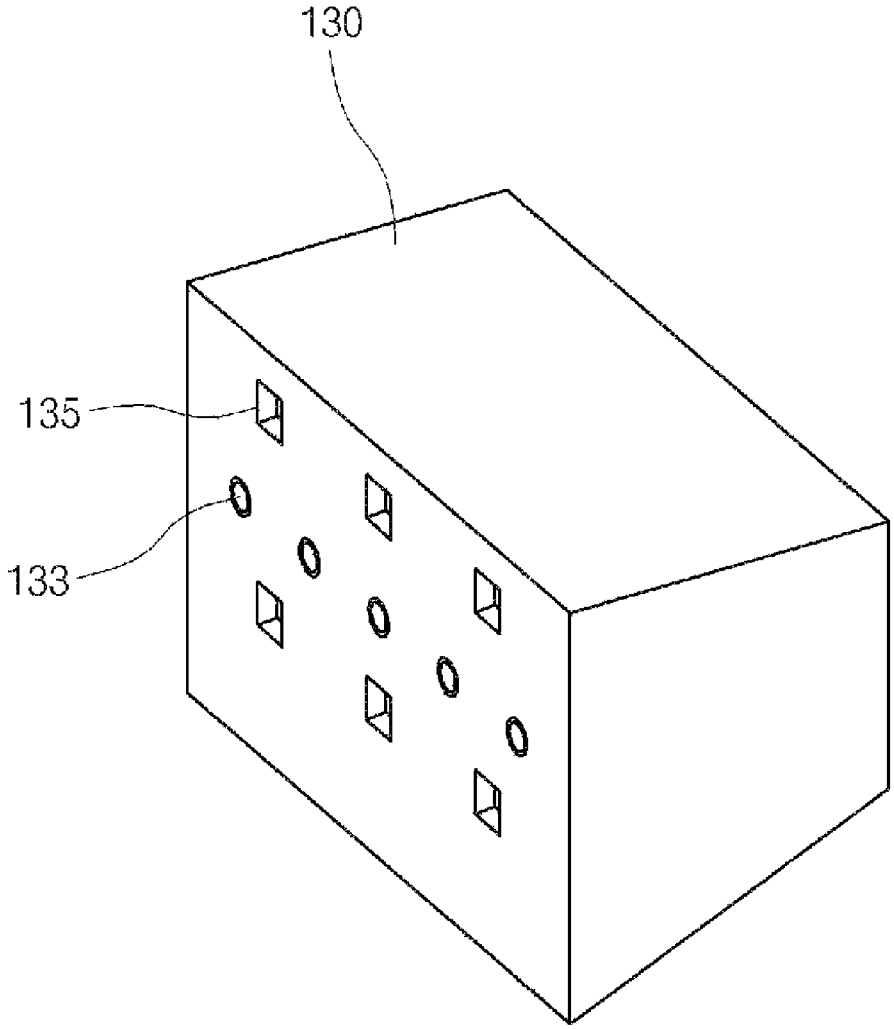
FIG. 14 is a perspective drawing representing the constitution of the additional segment of FIG. 10.

FIG. 2 is a side view representing coping constitution according to the method for constructing precast coping for bridge of the present invention; FIG. 3 is a side section representing coping constitution according to the method for constructing precast coping for bridge of the present invention; FIG. 4 is a perspective drawing representing the constitution of the main segment of FIG. 2; FIG. 5 is an exploded drawing representing the constitution of another embodiment of the main segment of FIG. 2; FIG. 6 is a perspective drawing representing the constitution of the subsegment of FIG. 2; FIG. 7 is a perspective drawing representing the constitution of the precast coping according to the method for constructing precast coping for bridge of the present invention; FIG. 8 is a perspective drawing representing the constitution of the lifting lug of the precast coping of the present invention; FIG. 9 is an exploded drawing of FIG. 8; FIG. 10 is a side view representing the constitution of the precast coping according to another embodiment of the method for constructing precast coping for bridge of the present invention; FIG. 11 is a side section representing the constitution of precast coping according to another embodiment of the method for constructing precast coping for bridge of the present invention; FIG. 12 is a perspective drawing representing the constitution of the main segment of FIG. 10; FIG. 13 is a perspective drawing representing the constitution of the subsegment of FIG. 10; FIG. 14 is a perspective drawing representing the constitution of the additional segment of FIG. 10.

Referring to FIGS. 2 to 14, the method for constructing precast coping for bridge of the present invention consists of precast coping (100), a main segment (110), and a subsegment (120).

First, when the main segment (110) is formed like a bigger cuboid than the diameter of the top segment (101) among pier body segments, the bottom of the main segment (110) is match-cast by using the upper side of the top segment (101) and molding; the main segment (110) includes a socket (111) corresponding to a shear connector (101*a*) of the body segment (101), a longitudinal sheath pier (113), and vertical and horizontal steel bars (115); and the main segment (110) forms a first transverse sheath pier (117) to penetrate transverse tendons (140). Here, the main segment (110) is connected to each other upon assembling a subsegment (120), explained as below, and includes a plurality of protruded shear keys (119) on both ends to effectively support top load.

Meanwhile, when road transport load of one segment of the main segment (110) is exceeded according to traffic law, two divided sides are match-cast manufactured each other, a plurality of protruded shear connectors (111*a*) are installed to the bottom of divided sides, and the socket (111) is installed to combine a shear connector (110*a*) to the upper side of divided sides when the main segment (110) is horizontally divided as shown in FIG. 5. Further, if the main segment (110) is divided, each epoxy (160) is applied and adhered to the partition side. Furthermore, if the main segment (110) is divided, separate longitudinal tendons (not illustrated) may be applied for interconnection upon lifting.

Also, when the subsegment (120) includes vertical and horizontal steel bars (121) inside the subsegment (120) and is shaped like a smaller cuboid than the main segment (110) in terms of length and height, the bottom of the subsegment (120) is on a slant to reduce self weight and focus on weight toward the main segment (110), and a second transverse sheath pier (123) corresponding to a first transverse sheath pier (117) of the main segment (110) is formed to penetrate transverse tendons (140). Here, the subsegment (120) is manufactured by match-cast using both ends of the main segment (110) as molding, and a shear key groove (125) combined to the shear key (119) of the main segment (110) is formed to the one side.

In addition, an additional segment (130) may be further installed by the outer of each subsegment (120) in the present invention.

At this point, a plurality of protruded subshear keys (127) are installed to the other side of the additional segment (120).

Further, when the additional segment (130) includes vertical and horizontal steel bars (131) inside the additional segment (130) and is shaped like a smaller cuboid than the subsegment (120) in terms of length and height, the bottom of the additional segment (130) is on a slant to reduce self weight and focus on weight toward the main segment (110), and a third transverse sheath pier (133) corresponding to a first transverse sheath pier (117), which is placed on the top of the first sheath pier (117) of the main segment (110), is formed to penetrate transverse tendons (140). Here, the additional segment (130) is manufactured by match-cast using one side of the subsegment (120) as molding, and a subshear key groove (135) combined to the subshear key (127) of the additional segment (120) is formed to the one side.

Meanwhile, as illustrated in FIG. 4, it is desirable to install a plurality of lifting lugs (150) on the surface of the main segment (110) in the present invention; and the number of the main segment (110) and the subsegment (120) or the main segment (110), the subsegment (120) and the additional segment (130), respectively, are determined upon the total weight, and 4 cases are applied in the present invention.

At this point, as illustrated on FIGS. 8 and 9, the lifting lug (150) consists of: a plurality of anchors (151) for forming a tap (151-3) to combine nuts (151-1) on the top, forming a curve (151-5) on the bottom, welding and fixing the horizontal steel bar (115) of the main segment (110) to the top and the bottom, and protrudedly forming the top toward the top of the main segment (110) when the anchors (151) are shaped like a circle stick; a base (153) for forming a first anchor hole (153-1), into which the anchor (151) is penetrated, and being horizontally laid on the top of the main segment (110) when the base (153) is shaped like a metal rectangular plate; a slab (155) for forming a second anchor hole (155-1), into which the anchor (151) is penetrated, and being fixed to the upper side of the main segment (110), which is the position corresponding to the base (153) when the slab (155) is shaped like a metal rectangular plate as the same as the base (153); and transverse tendons (157) for being longitudinally welded and combined in the center of the upper side of the slab (155).

Here, transverse tendons (157) consist of: a main body (157-1) for protrudedly forming a center with a curve, forming a lifting hole (157-11), and being vertically welded and connected to the upper side of the slab (155) when the main body (157-1) is shaped like a metal rectangular plate; a reinforcing raised spot (157-3) which is all formed around the lifting hole (157-11) of the main body (157-1); and a support panel (157-5) for welding one side in order to be vertically crossed with the main body (157-1), vertically welding and combining the bottom to the upper side of the slab (155), and supporting both ends of the main body (157-1).

Meanwhile, it is desirable to apply and adhere epoxy (160) between the main segment (110) and the subsegment (120) or the subsegment (120) and the additional segment (130), and the connection part of the main segment (110) and the subsegment (120) or the subsegment (120) and the additional segment (130) is not piled up with bridge support (that is called, shoe, not illustrated).

Furthermore, the main segment (110) and the additional segment (120), or the main segment (110), the subsegment (120) and the additional segment (130) determine partition number of each segment depending upon road transport load.

Hereinafter, the method for constructing precast coping for bridge of the present invention is specifically explained referring to attached drawings as below.

FIGS. 15 to 18 are process drawings explaining the method for constructing precast coping for bridge according to the present invention.

First, each lifting lug (150) is formed in the center of the surface of the main segment (110) in accordance with design.

Figure 15:
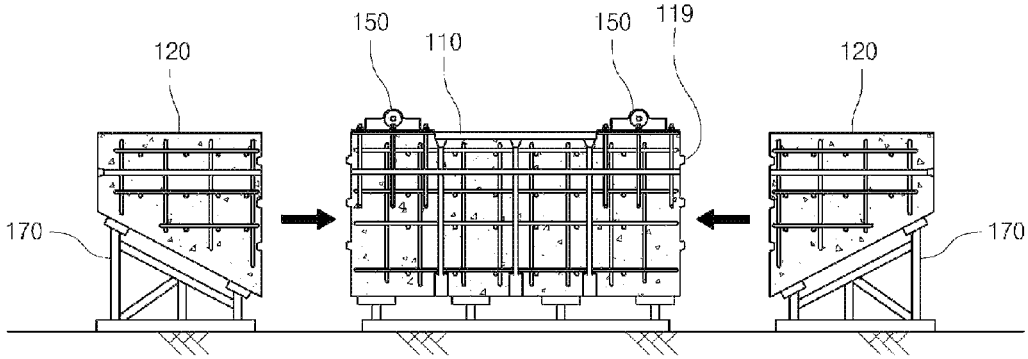
FIGS. 15 to 18 are process drawings explaining the method for constructing precast coping for bridge according to the present invention.

Next, as illustrated in FIG. 15, the subsegment (120) is installed to the side of the main segment (110) on the ground. At this point, the side of the main segment (110) and the subsegment (120) is covered with the epoxy (160). Also, match-cast sides are installed to be interconnected upon manufacturing the subsegment (120), and the shear key (119) of the main segment (110) and the shear key groove (125) of the subsegment (120) is installed to be faced each other. Further, it is desirable to install a support (170) which enables to support the main segment (110) and the subsegment (120) on the ground before combining the main segment (110) with the subsegment (120).

Figure 16:
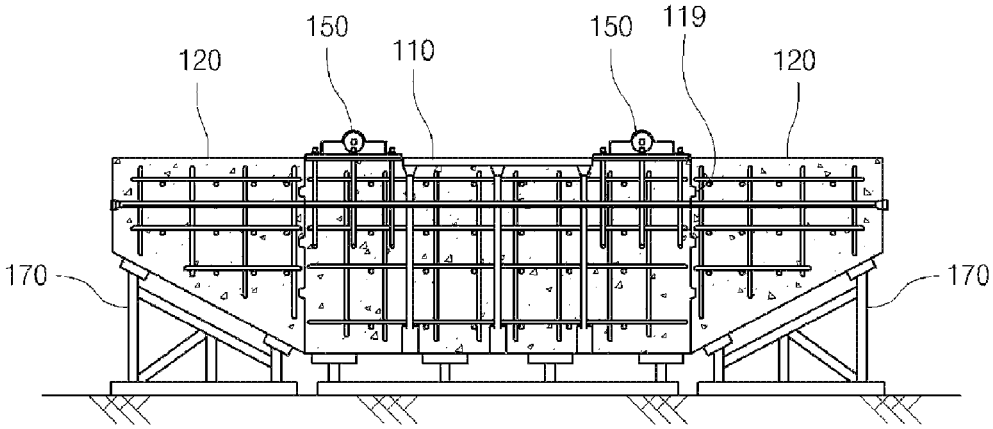
Figure 17:
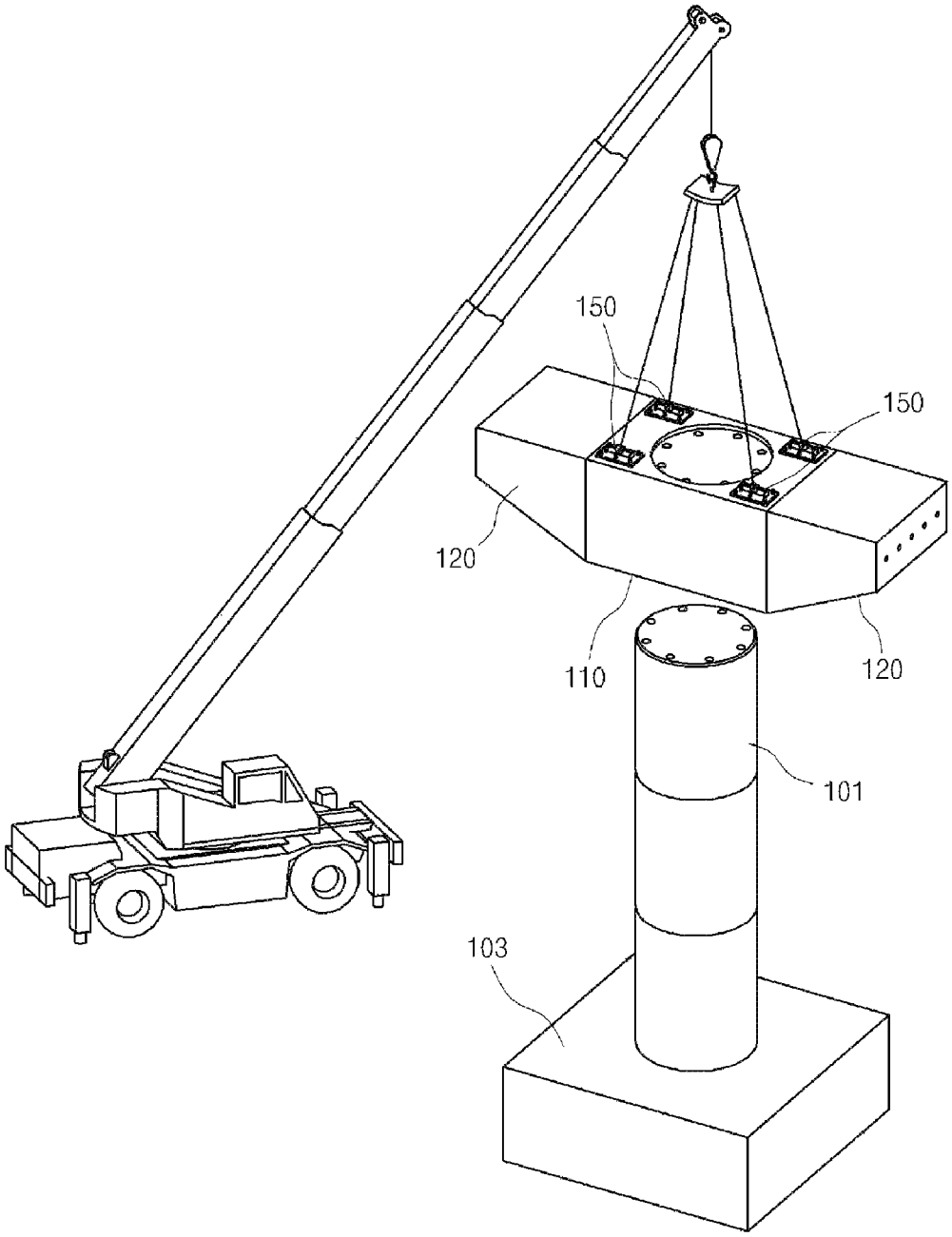

In this condition, as illustrated in FIG. 16, transverse tendons (140) are penetrated into a first transverse sheath pier (117) of the main segment (110) and a second transverse sheath pier (123) of the subsegment (120) and then, tendon force is applied at once by tensioning the transverse tendons (140).

Meanwhile, the additional segment (130) may be further combined to the subsegment (120) of the present invention.

That is, the additional segment (130) is installed to each of both sides of the subsegment (120). At this point, the side of the subsegment (120) is covered with the epoxy (160); the subshear key (127) is formed to the side of the subsegment (120); match-cast sides are installed to be interconnected upon manufacturing the additional segment (130); and the subshear key (127) of the subsegment (120) and the subshear key groove (135) of the additional segment (130) is installed to be faced each other.

Next, transverse tendons (140) are penetrated into a first transverse sheath pier (117) of the main segment (110), a second transverse sheath pier (123) of the subsegment (120) and a third transverse sheath pier (133) of the additional segment (130) and then, transverse tendon force is applied at once by tensioning the transverse tendons (140).

Then, after constructing a bridge base (103) on the surface, the pre-made bridge segment is piled up on the upper side of the bridge pier (103) to the designed height in sequence.

Next, as illustrated in FIG. 16, the coping, which is completed to be assembled on the ground, i.e., the main segment (110) and the subsegment (120) or the main segment (110), the subsegment (120) and the additional segment (130), is lifted after connecting lifting devices, such as a crane, and lifting lug (150) by wires or ropes and then, the main segment (110) is piled up on the upper side of the body segment (101). At this point, the shear connector of the body segment (101) is interconnected with the socket (111) of the main segment (110).

Figure 18:
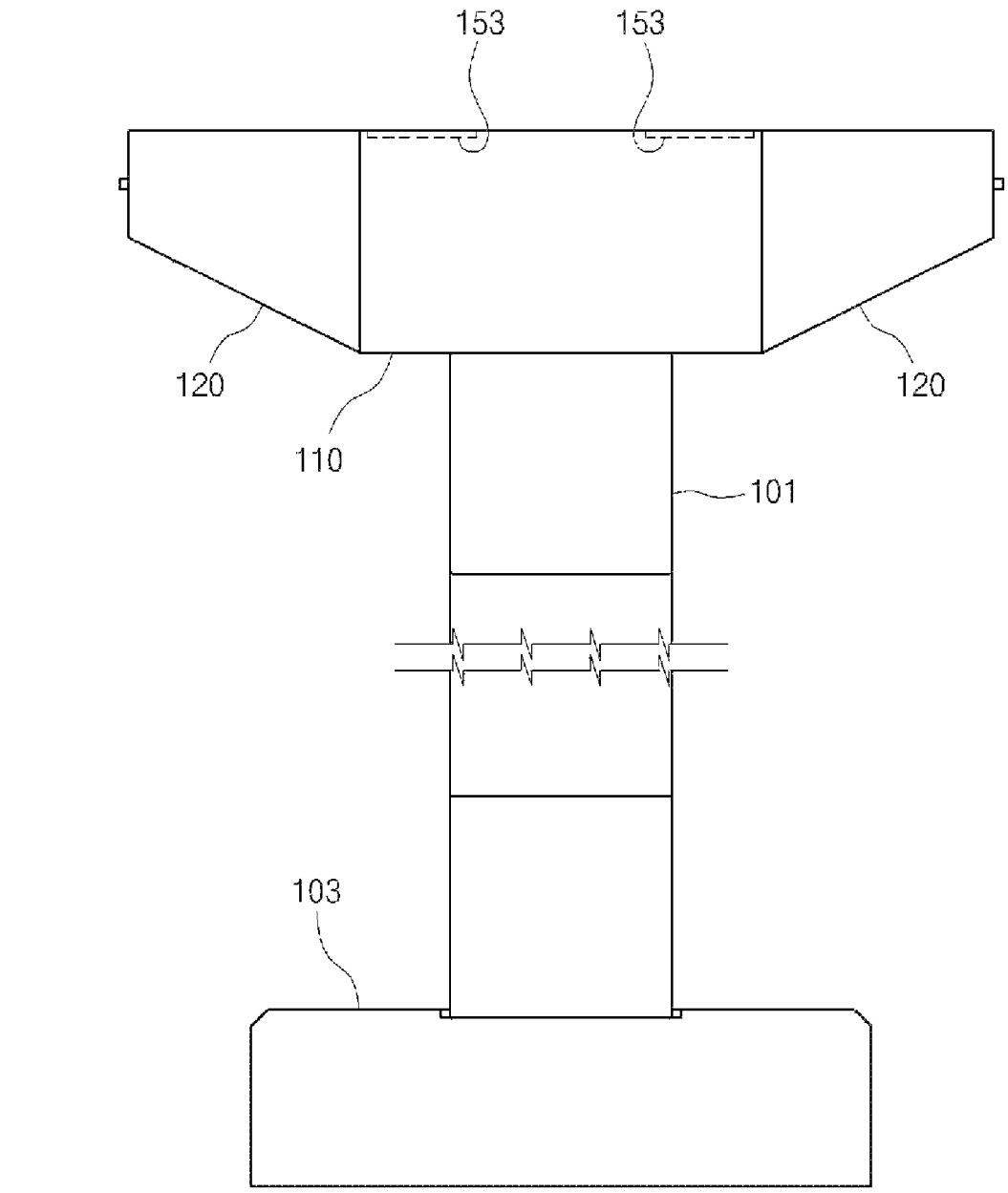

In this condition, as illustrated in FIG. 18, the coping is completed by tensioning longitudinal tendons (105) inserted into the longitudinal sheath pier (113) and applying longitudinal tension force.

Meanwhile, even though the process for lifting and combining the coping after assembling the coping on the ground is described, the main segment (110) and the subsegment (120) or the main segment (110), the subsegment (120) and the additional segment (130) may be lifted and installed in sequence while the body segment (101) is installed. At this point, after first performing longitudinal tension between the main segment (110) and the body segment (101), transverse tension is performed.

The present invention can be variously modified and embodied by several types of forms, and particular illustrative embodiments are merely described in the detailed description of the invention. However, it should be appreciated in such a manner that the present invention is not limited as a particular type, mentioned in the detailed description, but rather it comprises all modified materials, equal materials, and substitutes within the spirit and the range of the present invention, defined by the enclosed claims herewith.

What is claimed is:

1. A method for constructing precast coping for bridge, comprising:

manufacturing a main segment to be stacked on an upper side of a top segment of pier body segments, wherein a bottom of the main segment is match-cast manufactured by using a surface of the top segment as molding, and a first transverse sheath pier penetrating transverse tendons is formed in the main segment;

manufacturing a subsegment to build a second transverse sheath pier corresponding to the first transverse sheath pier of the main segment, wherein the subsegment is match-cast manufactured by using sides of the main segment as molding;

introducing transverse tendon force through the transverse tendons which are inserted to the first transverse sheath pier and the second transverse sheath pier after combining the subsegment to the sides of the main segment; and introducing longitudinal tendon force through longitudinal tendons inserted to a longitudinal sheath pier after lifting the main segment in which the subsegment is combined and stacking the main segment an upper side of the pier body segments.

2. The method for constructing precast coping for bridge according to claim 1, further comprising manufacturing an additional segment to form a third transverse sheath pier corresponding to the first transverse sheath pier and the second transverse sheath pier penetrating the transverse tendons, wherein the addition segment is match-case manufactured by using sides of the segment are used as molding.

3. The method for constructing precast coping for bridge according to claim 1, wherein the main segment includes:

a socket corresponding to a shear connector of the main segment, a longitudinal sheath pier, a vertical steel bar, and a horizontal steel bar.

4. The method for constructing precast coping for bridge according to claim 2, further comprising installing a plurality of lifting lugs on an upper side of the main segment, and installing a plurality of protruded shear keys on sides of the main segment.

5. The method for constructing precast coping for bridge according to claim 4, wherein each lifting lug comprises:

a plurality of anchors for forming a tap to combine nuts at a top, forming a curve at a bottom, welding and fixing the horizontal steel bar of the main segment to the top and the bottom, wherein the plurality of the anchors are protruded at a top of the main segment, and the anchors are shaped like a circle stick;

a base for forming a first anchor hole, into which an anchor is penetrated, the base being horizontally laid on the top of the main segment, and the base being shaped like a metal rectangular plate;

a slab for forming a second anchor hole, into which the anchor is penetrated, the slab being fixed to any one of upper sides of the main segment, subsegment, and additional segment, by a nut of the anchor, the slab being shaped like a metal rectangular plate; and the transverse tendons for being longitudinally welded and combined in a center of an upper side of the slab.

6. The method for constructing precast coping for bridge according to claim 5, wherein each transverse tendon comprises:

a main body for protrudedly forming a center with a curve, forming a lifting hole, and being vertically welded and connected to an upper side of the slab, the main body being shaped like a metal rectangular plate;

a reinforcing raised spot which is formed around the lifting hole of the main body; and a support panel for welding one side in order to be vertically crossed with the main body, vertically welding and combining a bottom to an upper side of the slab, and supporting both ends of the main body.

7. The method for constructing precast coping for bridge according to claim 3, wherein if road transport load of the main segment exceeds a limit, two divided sides are match-cast manufactured each other, a plurality of protruded shear connectors are installed at bottom of the divided sides, and the socket is installed to combine a shear connector to an upper side of the divided sides, the main segment being horizontally divided.

8. The method for constructing precast coping for bridge according to claim 4, wherein the subsegment includes a shear key groove combined to a shear key of the main segment in one side, and a plurality of protruded subshear keys formed in other sides.

9. The method for constructing precast coping for bridge according to claim 8, wherein the additional segment includes a subshear key groove combined to a subshear key of the subsegment in one side.

10. The method for constructing precast coping for bridge according to claim 2, wherein epoxy is applied and adhered between the main segment and the subsegment or between the subsegment and the additional segment.

11. The method for constructing precast coping for bridge according to claim 2, wherein a connection part of the main segment and the subsegment or the subsegment and the additional segment is not piled up with bridge support or critical sections.

12. The method for constructing precast coping for bridge according to claim 2, wherein a number of partitions of each of the main segment, the subsegment and the addition segment is determined depending upon road transport load.

* * * * *